United States Patent [19]

Westhead

[11] Patent Number: 4,870,998

[45] Date of Patent: Oct. 3, 1989

[54] LOW STRETCH PAPERMAKING FABRIC

[75] Inventor: William T. Westhead, Waycross, Ga.

[73] Assignee: SCAPA, Inc., Waycross, Ga.

[21] Appl. No.: 253,915

[22] Filed: Oct. 6, 1988

Related U.S. Application Data

[63] Continuation of Ser. No. 014,397, Feb. 13, 1987, abandoned.

[51] Int. Cl.[4] ..... D21F 1/10

[52] U.S. Cl. ..... 139/383 A; 139/415; 162/348

[58] Field of Search ..... 139/383 A, 383 HA, 415, 139/425 A; 162/DIG. 1, 348; 428/255, 257

[56] References Cited

U.S. PATENT DOCUMENTS

| | | | |
|---|---|---|---|
| 1,879,243 | 9/1932 | Hoffacker | 139/415 |
| 2,158,007 | 5/1939 | Ellis, 3d. et al. . | |
| 2,332,393 | 10/1943 | Neville | 139/383 A |
| 2,797,713 | 7/1957 | Hoffacker | 139/383 A |
| 2,949,134 | 8/1960 | Hindle et al. | 139/383 A |
| 3,957,090 | 5/1976 | Muhlen et al. . | |
| 4,026,331 | 5/1977 | Lees et al. . | |
| 4,149,571 | 4/1979 | Burroughs | 139/425 A |
| 4,182,381 | 1/1980 | Gisbourne . | |
| 4,244,084 | 1/1981 | Gisbourne . | |
| 4,290,209 | 9/1981 | Buchanan et al. . | |
| 4,315,049 | 2/1982 | Fickers . | |
| 4,407,333 | 10/1983 | Fowkes | 139/415 |
| 4,467,839 | 8/1984 | Westhead . | |
| 4,476,902 | 10/1984 | Westhead . | |
| 4,564,052 | 1/1986 | Borel | 138/383 A |

FOREIGN PATENT DOCUMENTS

| | | | |
|---|---|---|---|
| 53238 | 10/1933 | Norway | 139/383 A |

*Primary Examiner*—Henry S. Jaudon

*Attorney, Agent, or Firm*—Fleit, Jacobson, Cohn, Price, Holman & Stern

[57] ABSTRACT

A papermakers fabric in which a plurality of load control yarns are provided within the interior of the fabric. The load control yarns are not crimped during fabric manufacture, pass through the fabric in the machine direction, and are made from yarns containing Kevlar or similar low stretch, high strength type yarns and protected from abrasion, heat, and hydrolysis.

26 Claims, 4 Drawing Sheets

LOW STRETCH PAPERMAKING FABRIC

This application is a continuation of application Ser. No. 014,397, filed Feb. 13, 1987now abandoned.

BACKGROUND OF THE INVENTION

1. Field of the Invention

This invention relates to woven papermakers fabrics, and more particularly to an improved woven papermakers fabric that exhibits substantially less machine direction stretch and shrinkage than other available fabric structures.

2. Description of the Prior Art

In papermaking machines, a papermakers belt in the form of an endless, belt-like fabric structure is supported on and advanced by a plurality of metallic rolls rotatably supported in the papermaking machine. The belt serves to transport paper during the various stages of its processing during the papermaking process, as it passes through the papermaking machine. Papermakers belts have various names, depending upon the portion of the machine in which they are used. By way of example, papermakers belts can include so-called forminq fabrics, wet press felts, and dryer felts and fabrics. In many cases, the belt or fabric is joined at its ends to form an endless belt that is supported on and controlled by various machine rolls forming part of the papermaking machine.

A papermakers fabric can be made from a one, two, three, or more plane fabric, wherein the various planes are defined by different groups of cross-machine direction yarns. The planes, plies, or layers, as they are variously called, are united by a plurality of machine direction yarns that are interwoven with the cross-machine direction yarns to form a coherent fabric that has desired surface, stability and permeability characteristics, depending upon the portion of the papermaking process in which it is used. In that regard, the yarns that are used to weave the most modern papermakers fabrics are often made from synthetic monofilaments, or synthetic mutilfilaments, and from such materials as polyester or polyamide.

By virtue of the interwoven structure of the typical papermakers fabric, both the cross-machine direction yarns and the machine direction yarns are crimped, or bent, as they pass above or below the respective yarns with which they are interwoven. Although after weaving the fabric is subjected to heat and tension to set the yarns in the desired relative orientation, regardless of the tightness of the weave, any crimped machine direction yarn will increase in length as the fabric is placed under tension. Such a result is undesirable in that it causes the fabric to stretch and lengthen in the machine direction. As the fabric tension must be kept constant during the paper making process, fabric stretch can cause the fabric to lengthen beyond the take-up capabilities of the paper machine in which case tension is lost and the fabric has to be removed, because it is too long. Furthermore, if the tension applied to the fabric is relatively low, the fabric may shrink back, again beyond the adjustment capabilities of the machine. In this case the tension builds up and can result in damage to the paper machine. Further complicating the situation is that the tension in the fabric as it runs is not constant and uniform along the fabric, which brings about fluctuations as the fabric travels through the papermaking machine.

One attempt to overcome stretching of a papermakers fabric on the papermaking machine involved the technique of overstretching the fabric by the fabric manufacturer during the finishing operation. However, it has been found that finishing a woven fabric by using high stretch forces will result in built-in high shrinkage and consequent shrink forces that cause the fabric to contract on the paper machine to the point of tension build-up and subsequent machine damage. On the other hand, finishing a fabric by using low stretch forces will reduce the likelihood of it contracting on low tension positions of the machine, but it will increase the likelihood of it stretching in high tension positions on the machine. However, because in many cases neither the papermakers fabric manufacturer nor the paper mill that uses the fabric knows precisely under what tension the fabric will be operating, there is always the possibility of either fabric stretching or fabric shrinking.

It is an object of the present invention to overcome the above-described problems associated with the prior art fabric structures, and to provide a papermakers fabric that has improved resistance to stretching when under tension after being finished using low stretch forces, such that it performs well on a large variety of papermaking machines under a variety of operating conditions.

SUMMARY OF THE INVENTION

Briefly stated, in accordance with one aspect of the present invention, a papermakers fabric is provided in the form of a woven structure that includes a plurality of machine direction yarns and a plurality of cross-machine direction yarns that are interwoven according to a pre-selected weave pattern. The interwoven yarns define a woven structure having a top layer and a bottom layer. A plurality of load control yarns are positioned between the top and bottom layers of the fabric and extend in the machine direction and lie between the cross-machine direction yarns. The load control yarns pass linearly through the interior of the woven fabric structure and are substantially uncrimped. The load control yarns are made from a synthetic material capable of withstanding high tensile loads without appreciable stretch.

DESCRIPTION OF THE PREFERRED EMBODIMENTS

Figure 1:
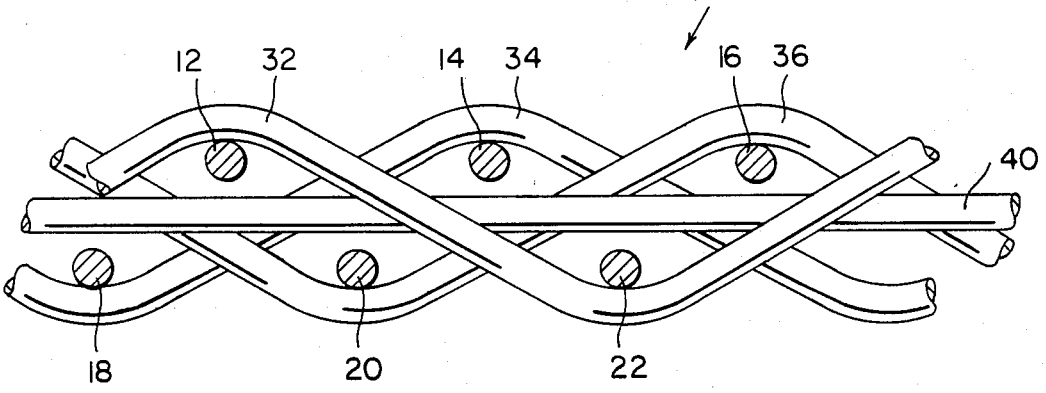
FIG. 1 is a fragmentary cross-sectional view, taken along the machine direction, of one type of weave pattern constructed in accordance with the present invention and having load control yarns passing through the interior portion of the fabric in the machine direction.

Referring now to the drawings, and particularly to FIG. 1, there is shown a portion of a papermakers fabric 10 that includes a plurality of cross-machine direction yarns 12 through 22 that are arranged in alternating relationship in a machine direction and interwoven with a plurality of groups of machine direction yarns 32, 34 and 36 (only one of each shown) to provide a substantially two layer, or duplex fabric. As is clearly apparent from FIG. 1, the base, or interwoven portion of the fabric is characterized by a weave pattern having three ends and a six pick repeat. In this regard, as is clearly shown in FIG. 1, the groups of machine direction yarns 32, 34 and 36 pass in identical undulating patterns back and forth between portions of the cross-machine direction yarns 12 through 22 in the top and bottom planes, and the machine direction yarns in each group engage and pass about every third cross-machine direction yarn portion in the top and bottom planes.

Fabric 10 includes a plurality of machine direction yarns 40 (only one of which is visible in FIG. 1) that pass directly through the center of the fabric structure, and are arranged in parallel relationship to define an intermediate plane within the fabric, the intermediate plane lying between the plane defined by upper cross-machine direction yarns 12, 14 and 16, and the plane defined by lower cross-machine direction yarns 18, 20 and 22. By passing straight through the fabric structure, and without being crimped, the center machine direction yarns 40, or load control yarns are able to undergo a higher tensile load without substantial stretch, as compared with machine direction yarns that are interwoven with cross-machine direction yarns.

The types of yarns that can be used to provide the base, interwoven fabric structure, exclusive of the load control yarns, can be any of a variety of synthetic materials such as polyesters, polyamides, and the like. For example, nylon has excellent resistance to abrasion, although it will extend or contract in use. Thus the preferred machine direction yarns, which can be selected to provide a standard temperature and hydrolysis resistant warp structure, preferably include a combination of polyester, nylon and acrylic yarns so engineered as to combine the best properties of each yarn. For example, the polyester and nylon yarns resist wear, the nylon and acrylic yarns resist hydrolysis, the polyester and acrylic yarns resist heat, and the polyester yarns give fabric stability. Similarly, a high temperature and hydrolysis resistant warp structure can include a combination of polyester, nylon, acrylic, Nomex, and Kevlar yarns. In that case the polyester and nylon yarns resist wear, the acrylic, nylon and Nomex yarns resist hydrolysis, the polyester, acrylic, and Nomex yarns resist heat, and the polyester and Kevlar yarns give fabric stability.

Figure 13:
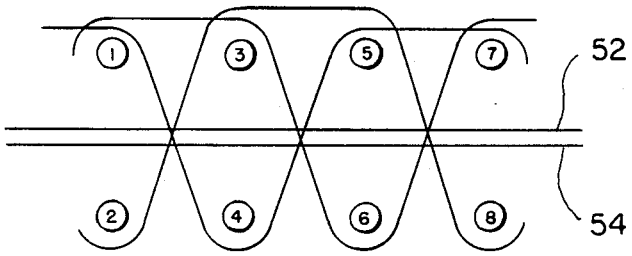

In the case of the cross-machine direction yarns, standard cross-machine yarns usually combine glass, polyester, and nylon and are engineered to give excellent cross-machine stability and medium to high permeability. However, for smooth face fabrics at low permeability, the cross-machine direction yarns are preferably glass and acrylic. Again, the yarns are engineered to give excellent cross-machine stability. Alternatively, a design having a machine direction float face can be used to produce a smooth face fabric as shown in FIG. 13. This can be produced with standard cross-machine yarns or, for ultra smoothness, can be produced with glass and acrylic or similar cross-machine yarns.

In the case of the load control yarns, the preferred material is Kevlar, which has high strength, but offers poor resistance to plucking-type wear. However, by using Kevlar as the straight-through load control yarns, advantage can be taken of its low stretch and high strength characteristics to control overall fabric stretch, and because the Kevlar yarns are in the interior of the fabric, they are at the same time fully protected from wear, and hence their relatively poor abrasion characteristics do not result in loss of fabric strength during fabric life on the paper machine. Similarly, when nylon is employed in the basic weave, because the nylon has excellent abrasion resistance, it will exhibit less wear, but the poor resistance of nylon to stretch and contraction is overcome because those properties of the fabric are controlled by the Kevlar yarns in the interior of the fabric. The suitability of Kevlar yarns as load control yarns is an unexpected result in view of Kevlar's known ease of degradation by exposure to heat and moisture, and because both heat and moisture are present in the papermaking machine, the suitability of Kevlar was questioned. Surprisingly, however, the Kevlar yarns, when employed as described above, provided excellent results. In particular, the Kevlar straight-through center machine-direction yarns were not attacked by the heat and moisture because they were protected by the outer yarns, and, further, because the Kevlar yarns were not crimped, they did not show the expected weakness at the apex of a crimp. The performance of Kevlar was markedly better than anticipated.

Figure 2:
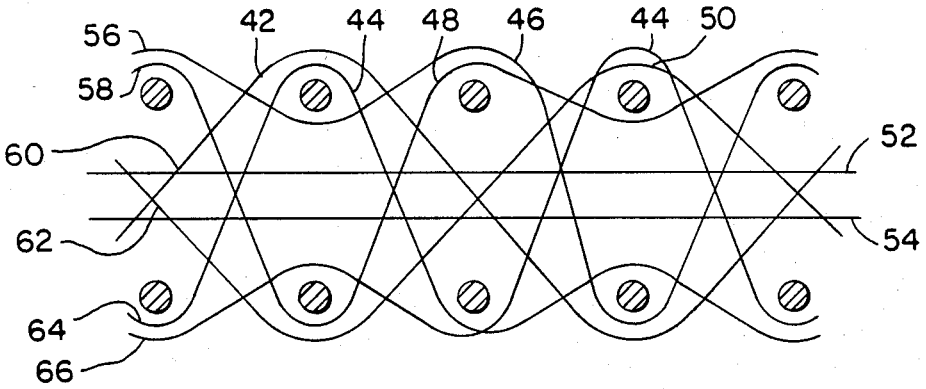
FIG. 2 is a fragmentary cross-sectional view similar to that of FIG. 1, showing another form of weave structure incorporating load control yarns in accordance with the present invention.
Figure 3:
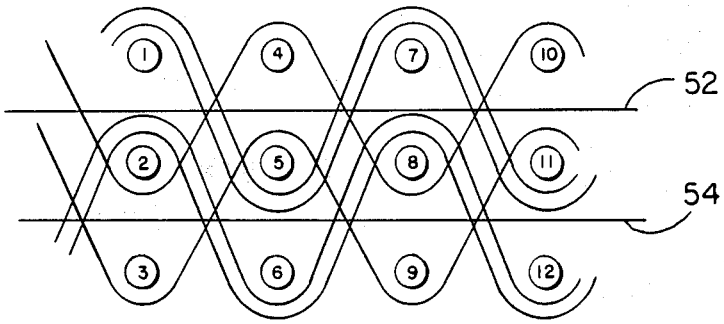
FIGS. 3 through 13 show alternative weave structures that incorporate load control yarns in accordance with the present invention.
Figure 4:
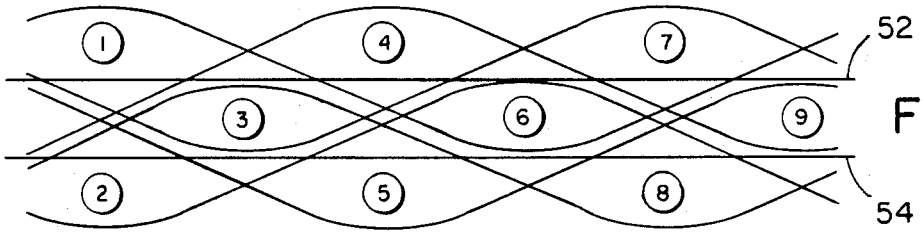

Referring now to FIG. 2, an alternative fabric structure is illustrated in which double machine direction yarn portions 42, 44 and 46, 48, for example, engage and pass over and partially around respective ones of each of the outwardly facing surfaces of each of the cross-machine direction yarns to further increase the resistance of the fabric to surface wear. This particular fabric structure is especially suitable where the fabric is subjected to a high degree of abrasion, as could exist, for example, when rusty or rough surface rolls are present in the papermaking machine. Additionally, as clearly apparent from the FIG. 2 embodiment, two load control yarns 52, 54 are provided in the same plane in each repeat of the fabric design. As is also clearly shown in FIG. 2, six machine direction yarns 56, 58, 60, 62, 64 and 66 are provided in the disclosed fabric structure, with the yarns 56, 58, 64 and 66 also having portions engaging and passing partially around inwardly facing surfaces of respective ones of the cross-machine direction yarns 12 through 22. Further, the machine direction yarns are arranged in respective pairs 56 and 66, 58 and 64, and 60 and 62, which are interwoven with the cross-machine yarns 12 through 22 in respective symmetrical patterns.

Figure 5:
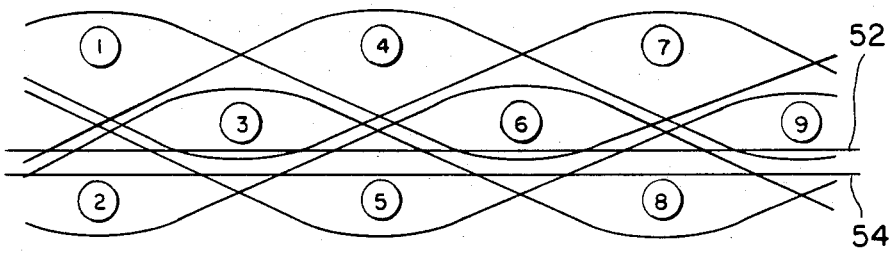
Figure 6:
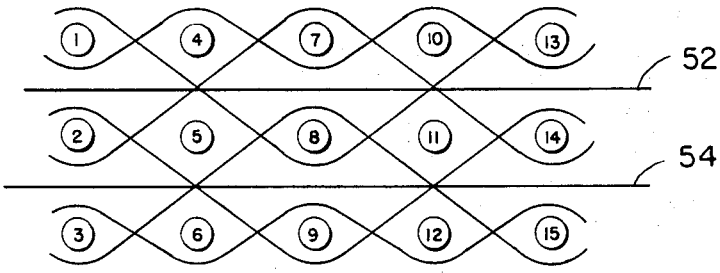
Figure 7:
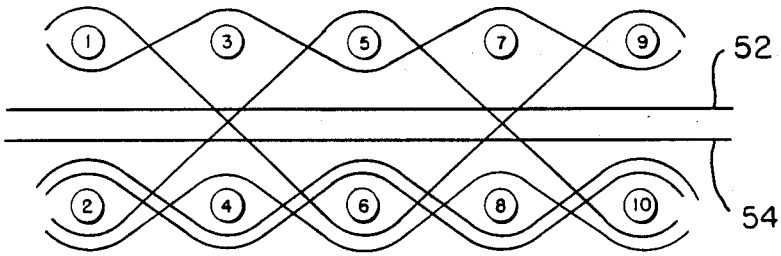
Figure 8:
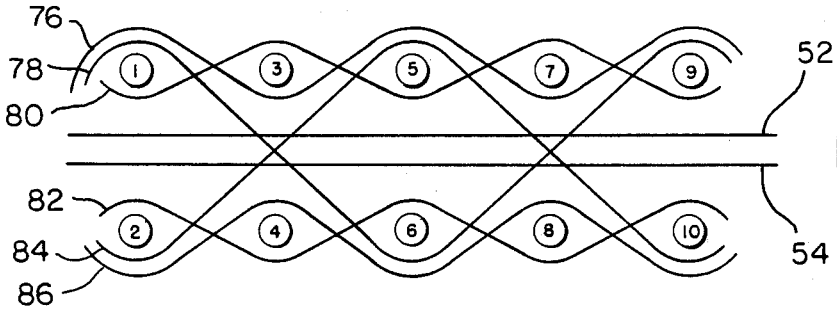
Figure 9:
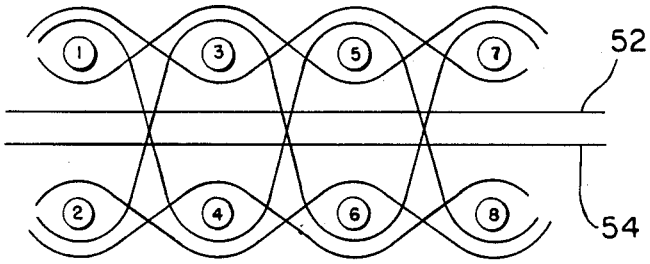
Figure 10:
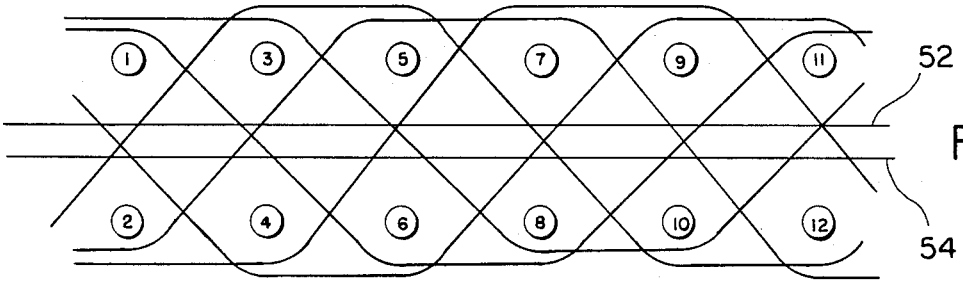
Figure 11:
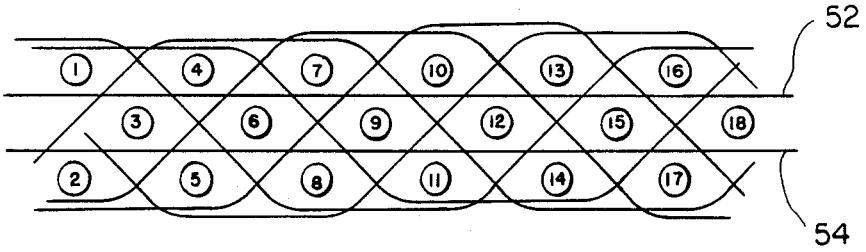
Figure 12:
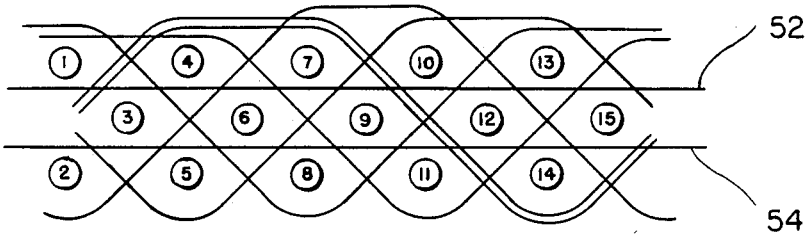

Additional possible base fabric weaves that can be provided and in which the load control yarn concept of the present invention can be employed are illustrated in FIGS. 3 through 13. In FIGS. 3, 4 and 6, 11 and 12, three-ply fabrics are illustrated, each having a pair of planes of load control yarns 52, 54. The two planes are each defined by a plurality of machine direction load control yarns, the planes being symmetrical with a center plane of the fabric structure and being equally spaced on each side of the center plane. In FIGS. 5 and 7 through 10 and 13, two-ply fabrics are illustrated, each having two load control yarns 52, 54 in the same plane in each repeat of the fabric design. In each fabric structure illustrated, load control yarns 52, 54 define either one or more parallel planes that pass through the fabric structure without being interwoven with the cross-machine yarns. The load control yarns are preferably either at the fabric center plane, or if plural planes are defined by the load control yarns, as in the structure shown in each of FIGS. 3, 4, 6, 11 and 12, the planes are preferably disposed at equal distances from the fabric center plane. However, as illustrated in FIG. 5, it is also possible to arrange the load control yarns so that they are disposed in a single plane on a single side of the fabric center plane, with two load control yarns 52, 54 being in the same plane in each repeat of the fabric design. Also, as FIG. 8 clearly shows, six machine direction yarns 76, 78, 80, 82, 84 and 86 are provided. Yarns 76, 78, 84 and 86 have portions engaging and passing partially around an outwardly facing surface portion of every other top plane and bottom plane cross-machine direction yarn portion. Additionally, the machine direction yarns in the fabric structure illustrated in FIG. 8 are arranged in respective pairs, 76, 86 and 80, 82. The respective pairs of machine direction yarns engage and pass partially around respective ones of the outwardly facing and inwardly facing surface portions of the cross-machine direction yarn portions in respective symmetrical patterns. Two of the machine direction yarns, 78 and 84, pass between top and bottom planes and partially around outwardly facing surface portions of the cross-machine direction yarns.

The fabrics that are made in accordance with the present invention can have their ends joined together to form an endless belt by using either metallic or non-metallic seams such as are well known to those skilled in the art.

In addition to permitting a fabric construction that has reduced stretch as compared with the prior known fabrics, the above-described fabric structures having load control yarns passing therethrough can be designed to provide fabric permeability in the range of from 0 to 600 cfm, depending upon the types of yarns and the type of weave that is employed.

Although, as pointed out above, several types of desired weave patterns can be employed to take advantage of the low stretch characteristics of weaves that incorporate load control yarns as hereinabove described, the preferred fabric structures for use on papermaking machines are the structures illustrated in FIGS. 1 and 2 of the drawings.

Although particular embodiments of the present invention have been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed is:

1. A stretch- and shrinkage-resistant dryer fabric comprising:

a low tension finished woven structure including a plurality of machine direction yarns and a plurality of cross-machine direction yarns made from at least one of polyester and polyamide material interwoven according to a preselected weave pattern to define the woven structure having at least a top plane and a bottom plane, and a plurality of load control yarns extending in the machine direction between said top and bottom planes and between said cross-machine direction yarns, said load control yarns being essentially straight and passing linearly and substantially uncrimped through the interior of the woven fabric structure, and said load control yarns being made from an aramid synthetic material having high strength and low shrinkage characteristics capable of withstanding high tensile loads without appreciable stretch under high heat and high tension, and being resistant to shrinkage under high heat and low tension, the plurality of machine and cross-machine direction yarns being arranged to cover the load control yarns so as to protect said load control yarns from wear and heat deterioration and the plurality of machine and cross-machine direction yarns having better abrasion characteristics than said load control yarns having better abrasion characteristics than said load control yarns so that full advantage is taken of the strength and resistance to stretch and shrinkage characteristics of said load control yarns.

2. A papermakers fabric in accordance with claim 1, wherein the load control yarns define a plane within the interior of the fabric structure, and the plane of the load control yarns lies substantially between the top and bottom planes of the fabric.

3. A papermakers fabric in accordance with claim 2, wherein the plane of the load control yarns is substantially parallel to the top and bottom planes.

4. A papermakers fabric in accordance with claim 2, wherein the plane of the load control yarns is substantially midway between the top plane and the bottom plane of the fabric.

5. A papermakers fabric in accordance with claim 1, wherein the plurality of load control yarns lies substantially in a single plane between the top and bottom planes of the fabric.

6. A papermakers fabric in accordance with claim 5, wherein the plane defined by the load control yarns is parallel to the top and bottom planes of the fabric.

7. A papermakers fabric in accordance with claim 5, wherein the machine direction yarns each pass over outwardly facing surfaces of each of outermost cross-machine direction yarns.

8. A papermakers fabric in accordance with claim 1, wherein planes defined by the load control yarns are spaced from each other.

9. A papermakers fabric in accordance with claim 8, wherein the planes defined by the load control yarns are substantially parallel to the top and bottom planes of the fabric.

10. A papermakers fabric in accordance with claim 9, wherein the planes defined by the load control yarns are spaced from and on opposite sides of a plane that passes through the center of the fabric.

11. The papermakers fabric as recited in claim 1, wherein:

said top and bottom planes include respective portions of the cross-machine direction yarns arranged in alternating relationship in the machine direction; and at least three groups of said machine direction yarns are interwoven with said cross-machine direction yarns in the pre-selected weave pattern, with said groups of machine direction yarns passing in identical undulating patterns back and forth between said cross-machine direction yarn portions in said top and bottom planes, and with said machine direction yarns in each group engaging and passing partially about the portions of every third cross-machine direction yarn in said top and bottom planes.

12. The papermakers fabric as recited in claim 1, wherein:

said top and bottom planes include respective portions of the cross-machine direction yarns arranged in vertically aligned pairs in the machine direction; and at least two machine direction yarns have yarn portions engaging and passing partially around an outwardly facing surface portion of each top plane and bottom plane cross-machine direction yarn portion, to increase resistance of the fabric to surface wear, each of the machine direction yarns passing between the top and bottom planes and partially around the outwardly facing surface portions of respective ones of the cross-machine direction yarn portions in both of the top and bottom planes.

13. The papermakers fabric as recited in claim 12, wherein at least six machine direction yarns are interwoven with said cross-machine direction yarns.

14. The papermakers fabric as recited in claim 12, wherein some of the machine direction yarns engage and pass partially around inwardly facing surface portions of respective ones of the cross-machine direction yarn portions in the top and bottom planes.

15. The papermakers fabric as recited in claim 14, wherein pairs of the machine direction yarns engage and pass partially around respective ones of the outwardly facing and inwardly facing surface portions of the cross-machine direction yarn portions in respective symmetrical patterns.

16. The papermakers fabric as recited in claim 1, wherein:

said top and bottom planes include respective portions of the cross-machine direction yarns arranged in vertically aligned pairs in the machine direction; and at least two machine direction yarns have yarn portions engaging and passing partially around an outwardly facing surface portion of every other top plane and bottom plane cross-machine direction yarn portion, to increase resistance of the fabric to wear.

17. The papermakers fabric as recited in claim 16, wherein at least six machine direction yarns are interwoven with said cross-machine direction yarns.

18. The papermakers fabric as recited in claim 16, wherein two of the machine direction yarns pass between the top and bottom planes and partially around the outwardly facing surface portions of respective ones of the cross-machine direction yarn portions in both of the top and bottom planes.

19. The papermakers fabric as recited in claim 18, wherein some of the machine direction yarns engage and pass partially around inwardly facing surface portions of respective ones of the cross-machine direction yarn portions in the top and bottom planes.

20. The papermakers fabric as recited in claim 19, wherein pairs of the machine direction yarns engage and pass partially around respective ones of the outwardly facing and inwardly facing surface portions of the cross-machine direction yarn portions in respective symmetrical patterns.

21. A dryer fabric comprising:

a low tension finished woven structure including a plurality of machine direction yarns and a plurality of cross-machine direction yarns made from at least one of polyester and polyamide material interwoven according to a preselected weave pattern to define the woven structure having at least a top plane and a bottom plane, a plurality of load control yarns extending in the machine direction between said top and bottom planes and between said cross-machine direction yarns, said load control yarns being essentially straight and passing linearly and substantially uncrimped through the interior of the woven fabric structure, and said load control yarns being made from an aramid synthetic material having high strength and low shrinkage characteristics capable of withstanding high tensile loads without appreciable stretch under high heat and high tension and said load control yarns also being resistant to shrinkage under high heat and low tension, the plurality of machine and cross-machine direction yarns being arranged to cover the load control yarns so as to protect the load control yarns from wear and heat deterioration and the plurality of machine and cross-machine direction yarns having better abrasion characteristics than the load control yarns so that full advantage is taken of the strength and resistance to stretch and shrinkage characteristics of the load control yarns, said top and bottom planes including respective portions of the cross-machine direction yarns arranged in alternating relationship in the machine direction, and at least three groups of said machine direction yarns are interwoven with said cross-machine direction yarns in the preselected weave pattern, with said groups of machine direction yarns passing in identical undulating patterns back and forth between said cross-machine direction yarn portions in said top and bottom planes, and with said machine direction yarns in each group engaging and passing partially about the portions of every third cross-machine direction yarn in said top and bottom planes.

22. A dryer fabric comprising:

a low tension finished woven structure including a plurality of cross-machine direction yarns made from at least one of polyester and polyamide material interwoven according to a preselected weave pattern to define the woven structure having at least a top plane and a bottom plane, a plurality of load control yarns extending in the machine direction between said top and bottom planes and between said cross-machine direction yarns, said load control yarns being essentially straight and passing linearly and substantially uncrimped through the interior of the woven fabric structure, and said load control yarns being made from an aramid synthetic material having high strength and low shrinkage characteristics capable of withstanding high tensile load without appreciable stretch under high heat and high tension and said load control yarns also being resistant to shrinkage under high heat and low tension, the plurality of machine and cross-machine direction yarns being arranged to cover the load control yarns so as to protect the load control yarns from wear and heat deterioration and the plurality of machine and cross-machine direction yarns having better abrasion characteristics than the load control yarns so that full advantage is taken of the strength and resistance to stretch and shrinkage characteristics of the load control yarns.

said top and bottom planes including respective portions of the cross-machine direction yarns arranged in vertically aligned pairs in the machine direction, and at least two machine direction yarns having yarn portions engaging and passing partially around an outwardly facing surface portion of every other top plane and bottom plane cross-machine direction yarn portion, to increase resistance of the fabric to wear.

23. The papermakers fabric as recited in claim 22, wherein at least six machine direction yarns are interwoven with said cross-machine direction yarns.

24. The papermakers fabric as recited in claim 22, wherein two of the machine direction yarns pass between the top and bottom planes and partially around the outwardly facing surface portions of respective ones of the cross-machine direction yarn portions in both of the top and bottom planes.

25. The papermakers fabric as recited in claim 24, wherein some of the machine direction yarns engage and pass partially around inwardly facing surface portions of respective ones of the cross-machine direction yarn portions in the top and bottom planes.

26. The papermakers fabric as recited in claim 25, wherein pairs of the machine direction yarns engage and pass partially around respective ones of the outwardly facing and inwardly facing surface portions of the cross-machine direction yarn portions in respective symmetrical patterns.

* * * * *

UNITED STATES PATENT AND TRADEMARK OFFICE

CERTIFICATE OF CORRECTION

PATENT NO. : 4,870,998

DATED : October 3, 1989

INVENTOR(S) : William T. Westhead

It is certified that error appears in the above-identified patent and that said Letters Patent is hereby corrected as shown below:

Claim 1, column 6, lines 9 and 10, cancel "having better abrasion characteristics than said load control yarns".

Signed and Sealed this

First Day of September, 1992

*Attest:*

DOUGLAS B. COMER

*Attesting Officer*

*Acting Commissioner of Patents and Trademarks*